US005400449A

United States Patent [19]

Satto

[11] Patent Number: 5,400,449

[45] Date of Patent: Mar. 28, 1995

[54] PRONE PREGNANCY CUSHION

[76] Inventor: Peter J. Satto, 10 Balsam Ct., Selden, N.Y. 11784

[21] Appl. No.: 309,727

[22] Filed: Sep. 21, 1994

[51] Int. Cl.[6] ..... A61G 7/04

[52] U.S. Cl. ..... 5/631; 5/632; 5/465; 5/930

[58] Field of Search ..... 5/462, 465, 930, 631, 5/632

[56] References Cited

U.S. PATENT DOCUMENTS

| | | | |
|---|---|---|---|
| 1,548,728 | 8/1925 | Milam | 5/930 X |
| 3,118,152 | 1/1964 | Talley, Sr. | 5/631 |
| 3,319,273 | 5/1967 | Solin | 5/465 X |
| 4,021,872 | 5/1977 | Powell | 5/930 X |
| 4,054,960 | 10/1977 | Pettit et al. | 5/930 X |
| 4,288,879 | 9/1981 | Pate | 5/462 X |
| 4,382,306 | 5/1983 | Lickert | 5/465 |
| 4,819,287 | 4/1989 | Halverson | 5/930 X |
| 4,822,309 | 4/1989 | Vandenberg | 5/465 X |
| 4,944,059 | 7/1990 | Wall | 5/431 |
| 5,054,142 | 10/1991 | Owens | 5/431 |
| 5,185,897 | 2/1993 | Van Laanen | 5/930 X |
| 5,237,712 | 8/1993 | Ramsay | 5/462 X |

FOREIGN PATENT DOCUMENTS

| | | | |
|---|---|---|---|
| 2687294 | 1/1993 | France | 5/930 |

*Primary Examiner*—Michael F. Trettel
*Attorney, Agent, or Firm*—Richard L. Miller

[57] ABSTRACT

A prone pregnancy cushion, for allowing a pregnant woman to lay on her abdomen, comprising an early stage segment, a later stage segment, and an attachment mechanism connecting the early stage segment and later stage segment. The early stage segment and later stage segment each have abdominal hollows and breast hollows, containing breast cut-outs and abdominal cut-outs which are removable to accommodate women of different sizes and at different stages of their pregnancy.

12 Claims, 1 Drawing Sheet

PRONE PREGNANCY CUSHION

BACKGROUND OF THE INVENTION

The invention relates to a prone pregnancy cushion. More particularly, the invention relates to a cushion for allowing a pregnant woman to lie face-down comfortably in all stages of her pregnancy.

During pregnancy, women undergo a great deal of stress, both mental and physical. The expectancy of motherhood can create a great deal of mental stress. It is necessary for the woman's health for her to be able to rest comfortably. Many woman are accustomed to resting face-down, and therefore cannot rest comfortably during their pregnancy.

In addition, the typical weight gain of a pregnant woman creates tremendous stress on the lower back. The growing fetus tends to project forwardly within the woman's abdomen. The added weight of the fetus causes an imbalance that the woman must compensate for by holding her upper torso back, and pushing her lower torso and pelvis forward. This posture adjustment adversely affects the distribution of weight throughout her body, particularly in the pelvis region. Doctors and chiropractors suggest that lying face-down would help relieve stress and pain on the lower back and pelvis.

U.S. Pat. No. 4,382,306 to Lickert, discloses a prenatal mattress for supporting the head, abdomen and other portions of the body of a pregnant user lying frontally downwardly thereupon.

U.S. Pat. No. 4,944,059 to Wall, discloses a prenatal body support upon which a pregnant woman may lay, that supports the abdomen, but does not support the knees and legs.

U.S. Pat. No. 5,054,142 to Owens, discloses a contoured body cushion that has a plurality of separate cushion segments for supporting various body parts.

U.S. Pat. No. 5,185,897 to Van Laanen, discloses an inflatable maternity mattress.

While these units may be suitable for the particular purpose employed, or for general use, they would not be as suitable for the purposes of the present invention as disclosed hereafter.

SUMMARY OF THE INVENTION

It is an object of the invention to provide a pregnancy cushion that comfortably supports a pregnant woman while laying down, so as to allow her to rest comfortably and relieve stress upon her lower back and pelvis.

It is another object of the invention to provide a pregnancy cushion that will adjust to accommodate women of different sizes, and women in different stages of their pregnancy.

It is still another object of the invention to provide a pregnancy cushion that supports the legs, as well as the abdominal and chest regions.

It is a further object of the invention to provide a pregnancy cushion that has removable portions to adjust to correspond to the increase in weight during pregnancy, and folds for convenient storage.

It is a still further object of the invention to provide a pregnancy cushion that is economical to manufacture.

The invention is a prone pregnancy cushion, for allowing a pregnant woman to lay on her abdomen, comprising an early stage segment, a later stage segment, and an attachment mechanism connecting the early stage segment and later stage segment. The early stage segment and later stage segment each have abdominal hollows and breast hollows, containing breast cut-outs and abdominal cut-outs which are removable to accommodate women of different sizes and at different stages of their pregnancy.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like reference numerals depict like elements throughout the several views. The drawings are briefly described below.

DETAILED DESCRIPTION OF THE PREFERRED EMBODIMENTS

Figure 1:
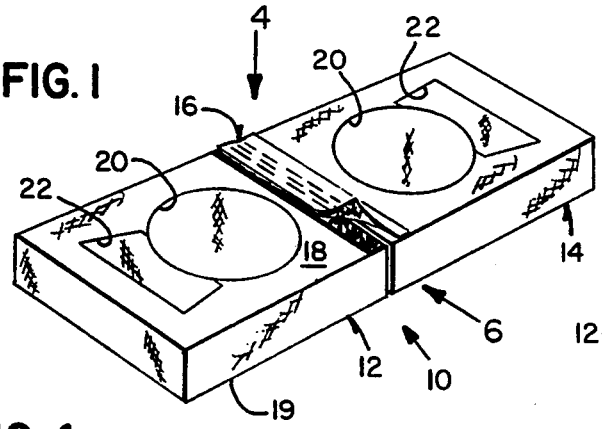
FIG. 1 is a diagrammatic perspective view of the instant invention per se.

FIG. 1 illustrates a pregnancy cushion 10. The pregnancy cushion 10 has an early stage segment 12 and a later stage segment 14. The early stage segment 12 and later stage segment 14 are rectangular prisms, and may be made of a foam-like substance. The early stage segment 12 and later stage segment 14 are joined by an attachment mechanism 16. The pregnancy cushion 10 has a top plane 18, and a bottom plane 19 opposite the top plane 18.

Figure 4:
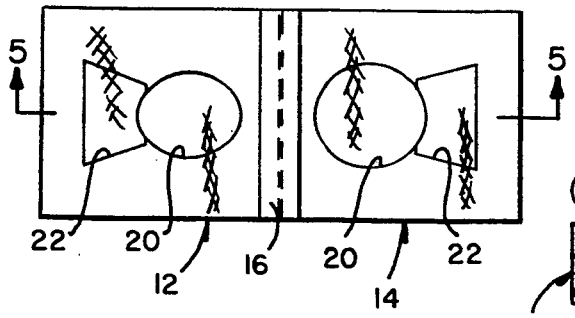
FIG. 4 is a top plan elevational view of the instant invention taken in the direction of arrow 4 in FIG. 1.

Referring to FIG. 1 and FIG. 4, the early stage segment 12 and later stage segment 14 each have an abdominal hollow 20 and a breast hollow 22, extending downward from the top plane 18. The abdominal hollow 20 is substantially circular, and the breast hollow 22 is substantially quadrilateral. The relative positioning of the abdominal hollow 20 and breast hollow 22 is such that the abdominal hollow 20 is nearer to the attachment mechanism 16, and the abdominal hollow 20 is adjacent to the breast hollow 22.

Figure 5:
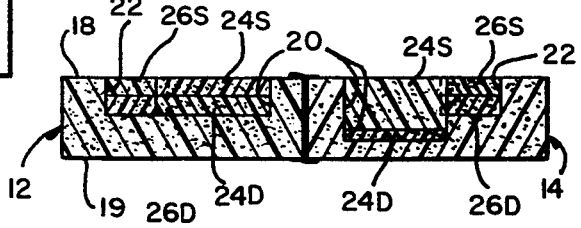
FIG. 5 is a is a cross sectional view taken on line 5—5 in FIG. 4.

FIG. 5 is a cross sectional view, illustrating further detail of removable portions of the pregnancy cushion.

In the early stage segment 12 and later stage segment 14, contained within the abdominal hollow 20 are a removable shallow abdominal cut-out 24S and a removable deep abdominal cut-out 24D, extending downward from the top plane 18 toward the bottom plane 19. Either the shallow abdominal cut-out 24S, or both the shallow abdominal cut-out 24S and deep abdominal cut-out 24D may be removed from the abdominal hollow 20 to accommodate abdomens of different sizes.

In the early stage segment 12 and later stage segment 14, contained within the breast hollow 22 are a shallow breast cut-out 26S and a deep breast cut-out 26D, extending downward from the top plane 18 toward the bottom plane 19. Either the shallow breast cut-out 26S, or both the shallow breast cut-out 26S and deep breast cut-out 26D may be removed from the breast hollow 22 to accommodate different size breasts.

The combination of the shallow abdominal cut-out 24S and deep abdominal cut-out 24D extend further downward in the later stage segment 14, than in the early stage segment 12.

Figure 2:
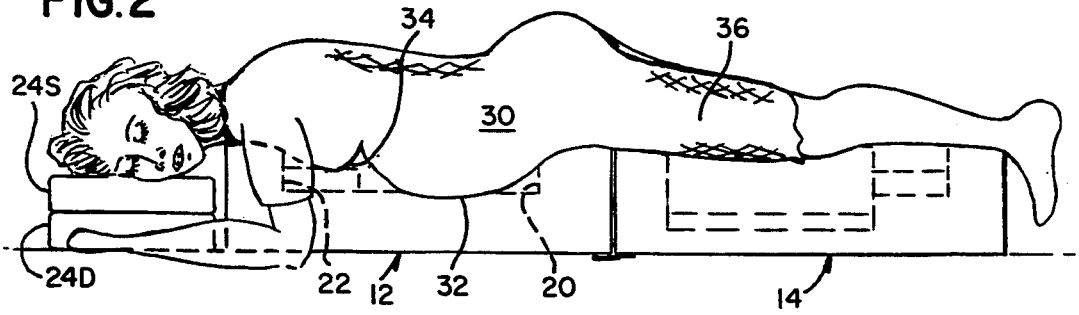
FIG. 2 is a diagrammatic enlarged side elevational view illustrating a woman in an early stage of pregnancy reclining on both portions of the instant invention.

FIG. 2 illustrates the use of the pregnancy cushion 10 by a pregnant woman 30, having an abdomen 32, breasts 34 and legs 36. The woman 30 has removed both the shallow abdominal cut-out 24S and deep abdominal cut-outs 24D from the early stage segment 12. The woman's abdomen 32 is extending into the abdominal hollow 20. The woman's breasts 34 are supported in the breast hollow 22. The woman's legs 36 are supported by the later stage segment 14, which is fully intact. The woman is using the shallow abdominal cut-out 24S and deep abdominal cut-out 24D as a pillow.

Figure 3:
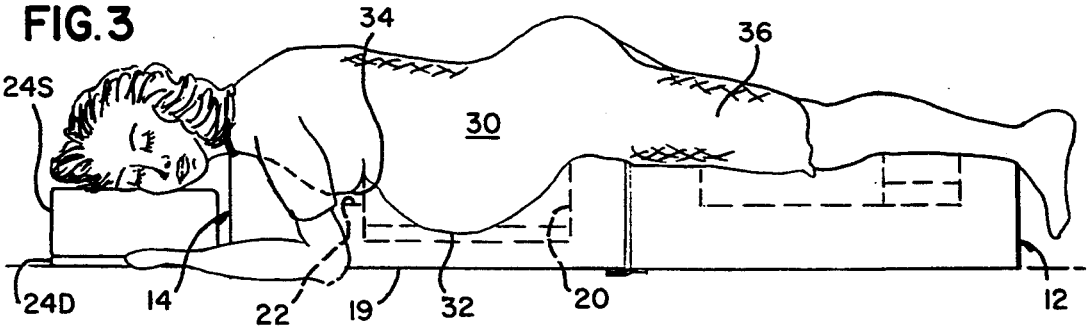
FIG. 3 is a diagrammatic enlarged side elevational view illustrating a women in a later stage of pregnancy reclining on both portions of the instant invention.

FIG. 3, illustrates the use of the pregnancy cushion 10 by the woman 30, who is now further along in her pregnancy. The woman 30 has removed both the shallow abdominal cut-out 24S and the deep abdominal cut-out 24D from the later stage segment 14. The woman's abdomen 32 is extending into the abdominal hollow 20. The woman's breasts 34 are supported in the breast hollow 22. The woman's legs 36 are supported by the early stage segment 12, which is fully intact. The woman is using the shallow abdominal cut-out 24S and deep abdominal cut-out 24D as a pillow.

The breast cut-outs 26S and 26D may be also removed to use as pillows.

Figure 6:
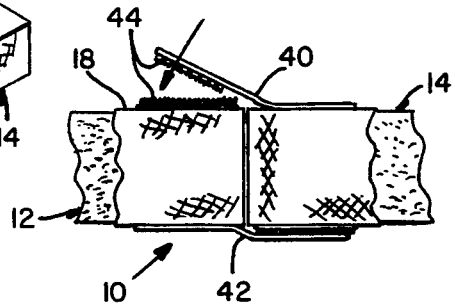
FIG. 6 is a diagrammatic side elevational view with parts broken away, taken in the direction of arrow 6 in FIG. 1.

FIG. 6 illustrates the attachment mechanism 16. The attachment mechanism has a top flap 40 and a bottom flap 42. The top flap 40 attaches the early stage segment 12 and later stage segment 14 at the top plane 18. The top plane and top flap 40 each have portions of a hook and loop pile fastener 44. The bottom flap 42 attaches the bottom plane 19 of both the early stage segment 12 and later stage segment 14, also using a hook and loop pile fastener. When the hook and loop pile fastener 44 joining the top plane 18 and top flap 40 is detached, the bottom flap 42 acts as a hinge, allowing the pregnancy cushion 10 to fold about the bottom flap 42, so the early stage segment 12 and later stage segment 14 stack atop one another for storage.

What is claimed is:

1. A pregnancy cushion, for supporting a pregnant woman laying face-down, comprising:

a) an early stage segment, in the shape of a rectangular prism having a top plane and a bottom plane, an abdominal hollow extending downward from the top plane toward the bottom plane, and a breast hollow extending downward from the top plane toward the bottom plane;

b) a later stage segment, in the shape of a rectangular prism having a top plane and a bottom plane, an abdominal hollow extending downward from the top plane toward the bottom plane, and a breast hollow extending downward from the top plane toward the bottom plane; and c) an attachment mechanism, connecting the early stage segment and later stage segment.

2. The apparatus as recited in claim 1, wherein the abdominal hollows further contain a shallow abdominal cut-out and a deep abdominal cut-out, the shallow abdominal cut-out and deep abdominal cut-out both being selectively removable, the deep abdominal cut-out extending further downward from the top plane.

3. The apparatus as recited in claim 2, wherein the combination of the shallow abdominal cut-out and deep abdominal cut-out extend further downward in the later stage segment than in the early stage segment.

4. The apparatus as recited in claim 3, wherein the breast hollows further contain a shallow breast cut-out and a deep breast cut-out, the shallow breast cut-out and deep breast cutout being selectively removable.

5. The apparatus as recited in claim 4, where in both the early stage segment and the later stage segment, the abdominal hollow is nearer to the attachment mechanism than breast hollow.

6. The apparatus as recited in claim 5, wherein the abdominal hollow and breast hollow are adjacent to one another in both the early stage segment and later stage segment.

7. The apparatus as recited in claim 6, wherein the attachment mechanism further comprises a top flap, attaching to the top plane of both the early stage segment and later stage segment, and a bottom flap, attaching to the bottom plane of both the early stage segment and later stage segment.

8. The apparatus as recited in claim 7, wherein the upper flap and top plane each bear portions of a hook and loop pile fastener device.

9. A method of using a pregnancy cushion by a pregnant woman, comprising an early stage segment and a later stage segment, the early stage segment and later stage segment connected with an attachment mechanism, the early and later stage segment each having a breast hollow and abdominal hollow containing removable breast cut-out portions and a removable abdominal cut-out portions, comprising the steps of:

a) performing a step selected from:

i) removing an abdominal cut-out portion in the early stage segment if the woman is at an early stage of her pregnancy, and ii) removing an abdominal cut-out portion in the later stage segment if the woman is at a later stage of her pregnancy; and b) laying down on the cushion with the abdomen extending into the abdominal hollow, and the legs supported by the segment in which the abdominal cut-out has not been removed.

10. The method as recited in claim 9, further comprising the step of: using as a pillow an item selected from the breast cut-out and abdominal cut-out.

11. The method as recited in claim 9, wherein the step of removing an abdominal cut-out further comprises removing a breast cut-out.

12. The method as recited in claim 9, wherein the abdominal cut-out comprises a deep abdominal cut-out and a shallow abdominal cut-out, and step of removing an abdominal cut-out is further selected from removing a shallow abdominal cut-out, and removing a shallow and deep abdominal cut-out, depending on the size of the abdomen.

* * * * *